United States Patent [19]

Lazarus

[11] Patent Number: 4,539,228

[45] Date of Patent: Sep. 3, 1985

[54] METHOD OF EXTENDING USEFUL LIFE OF INSTRUMENT STRINGS

[76] Inventor: Arnold Lazarus, 39 Seward St., San Francisco, Calif. 94114

[21] Appl. No.: 666,274

[22] Filed: Oct. 29, 1984

[51] Int. Cl.[3] ..... B05D 1/18

[52] U.S. Cl. ..... 427/180; 427/292; 427/295; 427/296; 427/316; 427/318; 427/434.6; 84/297 S; 84/199; 428/379

[58] Field of Search ..... 427/180, 292, 295, 296, 427/316, 318, 434.6, 430.1, 443.2; 428/379; 84/297 S, 199

[56] References Cited

U.S. PATENT DOCUMENTS

| | | | |
|---|---|---|---|
| 2,892,374 | 6/1959 | Ralls | 84/297 S |
| 3,911,192 | 10/1975 | Aronoff et al. | 428/379 |
| 4,377,620 | 3/1983 | Alexander | 84/297 S |

FOREIGN PATENT DOCUMENTS

| | | | |
|---|---|---|---|
| 2010631 | 6/1983 | Fed. Rep. of Germany | 84/297 S |

OTHER PUBLICATIONS

"What's New in the World of Guitars?", Kleiner, PTM, Jul., 1971, pp. 22 and 24.

*Primary Examiner*—Shrive P. Beck
*Attorney, Agent, or Firm*—Freilich, Hornbaker, Rosen & Fernandez

[57] ABSTRACT

The microscopic pores, cavities and crevices of the strings and the interstices of a wound string are filled with dry lubricant particles using a moisture displacing agent and rust inhibitor as a carrier for the dry lubricant. This provides lubrication and inhibits corrosion, thus shortening initial break in periods and extending string life.

6 Claims, 3 Drawing Figures

METHOD OF EXTENDING USEFUL LIFE OF INSTRUMENT STRINGS

BACKGROUND OF THE INVENTION

This invention relates to metal musical instrument strings, such as guitar, bass and piano strings, and more particularly to shortening the break-in period while at the same time extending the useful (prime sound) period.

Metal strings for musical instruments are either a single strand of wire or a core of nylon or silk tightly wrapped helically with a strand of wire, or a wire that is itself tightly wrapped helically with a strand of wire. Thus, the core of a wound string may itself be a strand of wire. The wound string will generally follow the basic laws of physics pertaining to a vibrating string under tension. Both the wound string and the single strand string require a break-in period, and their useful period is limited due to corrosion and the continuing process of "wearing-in."

The "break-in" period is characterized by "partials," which are tones disproportionate (in both amplitude and frequency) to the harmonics expected of the string. These partials can be described as extra brilliant to harsh, with the harshness quality generally attributed to many unpredictable partials. Another characteristic of the break-in period is the instability of the string to maintain tune. This instability manifests itself in a drifting of the frequency to which it is tuned.

The mechanism of the break-in period for the wound string is easier to visualize. When the string is in tension and played (displaced), the windings change position relative to each other, and relative to the core, and as the string returns to its rest position, the windings tend to return to their original position. Under vibration, there is continuous change of position. Due to surface roughness of the windings and the core, particularly if it is metal, there is not a smooth change of position as the string changes from an extreme of displacement on one side through the rest position to displacement on the other side. It is this roughness that produces the partials.

It is easy to observe this roughness through a 40× microscope in a string that has a 0.011" diameter core, a winding of 0.004" diameter wire for a total string diameter of 0.019". A string that has a core diameter of 0.020" and a winding of wire having a diameter of 0.017" (for a total string diameter of 0.054") will show its roughness even more easily. A single strand of wire will also show such roughness, and cause the same partials and instability observed with the wound strings for essentially the same reason. If viewed in a microscope with magnification much greater than 40×, the surface will appear like shattered safety glass with cracks running at random in every direction. Adjacent pieces of the cracked surface rub against each other as the string is played so that, until worn smooth during the break-in period, partials and instability will be experienced.

Once the string is broken-in, there is a continuous process of corrosion, which causes roughness, and wearing smooth the roughness due to corrosion. Consequently, an instrument that is played frequently will stay in tune and yield the expected harmonics, but with a limited useful life. An instrument played only infrequently will require retuning followed by another break-in period. In either case, there is continuous corrosion due to the atmosphere, as well as the acids and salts on the fingers of the person playing the instrument. It is this process of continuous corrosion and wearing smooth that limits the useful life (prime period) of the string, after which the string enters a "dead period" characterized by the string having a dull tone (very limited harmonics and very little sustain). It also does not stay in tune at all positions along the string.

OBJECTS AND SUMMARY OF THE INVENTION

An object of this invention is to increase the useful life of metal instrument strings.

Another object is to decrease the break-in period for metal instrument strings.

Yet another object is to provide a method which may be used by a consumer for extending the useful life and reducing the break-in period of metal instrument strings.

Still another object is to provide a wound string of a construction that optimizes the foregoing objects.

These objects of the invention are achieved by cleaning metal musical instrument strings so they are free from abrasive particles (dirt or dust), and filling the microscopic pores, cavities and crevices of the strings, and the interstices of a wound string, with dry lubricant particles, such as micronized TFE or PTFE, and saturate the lubricated string with a moisture displacing agent and corrosion inhibitor. In practice a dry lubricant, moisture displacing agent and rust inhibitor may be combined to form a solution with the dry lubricant in suspension. The filling step is then carried out simply by immersing the strings in a solution for a few days. Capillary forces will draw the solution into the pores, cavities, crevices and, in the case of wound strings, the interstices. If the moisture displacing agent or corrosion inhibitor is not to be introduced during this "filling" step, a volatile liquid may be used to form the solution for this filling, although dry lubricant can be introduced without a carrier solution by manually applying it to the string and working it in with the fingers.

DESCRIPTION OF PREFERRED EMBODIMENTS

Figure 1:
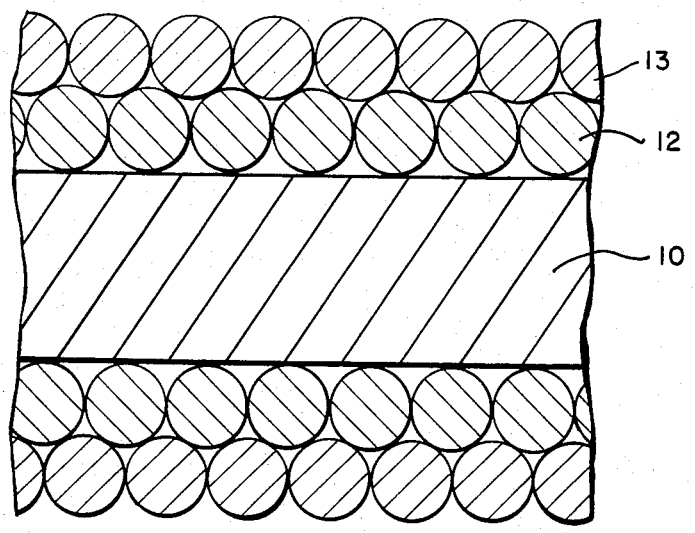
FIG. 1 illustrates a longitudinal cross section of a small length of a wound string to show the contact of the winding with the core and the contact between turns of the winding.

Referring to FIG. 1 of the drawings, a wound string consists of a core 10 and at least one helical winding 12. In the case of two or more windings, the additional windings are wound with the center line of the added winding over the spiral contact line between turns of the winding already in place, as shown for a second winding 13, so that each turn of the second winding is in contact with adjacent turns of the first winding as well as of the second winding.

When the string of FIG. 1 is in tension, and at rest, the windings will be in contact with each other, and in the case of the first windings, in contact with the core. Assuming that the core is also made of metal, it can be appreciated that as the string is played (displaced) so that it will vibrate, there is continuous movement of the turns relative to each other and the core.

Figure 2:
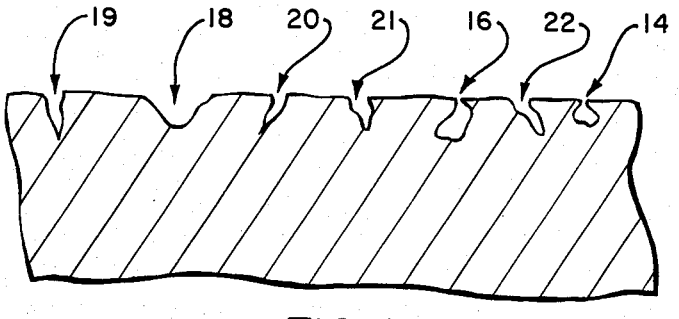
FIG. 2 illustrates a greatly magnified cross section of the surface of metal wire used for the winding on a wound string, or of the string itself in the case of an unwound string, to show the pores, cavities and crevices.

Under a 40× microscope, the surface of the wire used in the windings, and sometimes the core as well, is easily observed to have pores, cavities and crevices, as shown in FIG. 2. A pore is illustrated at 14 and 16, and a cavity at 18. Other surface imperfections illustrated at 19 through 22 may be classed as crevices. However, such classification is not important. What is important is the recognition that the wire is covered with such microscopic imperfections. The rough surface structure creates friction between the core and the turns of windings, and between the turns of the windings themselves. The core even creates friction within itself as the string vibrates after having been played, as when walls of crevices rub against each othe, or the mouth of a pore closes and its edges rub against each other. Consequently, even a single wire string will have a "break-in" period during which the friction is reduced by "wearing in," which is to say by polishing the rough edges of the imperfections to the point of minimum friction.

As noted hereinbefore, the break-in period is significant, and even after the initial break in, it may be necessary to again break in the strings and retune the instrument if corrosion has restored the roughness after an extended period of being at rest. Such corrosion will occur naturally in the atmosphere, but will be increased by acids and salts from the fingers of the musician. Roughness is also caused by friction of dust particles. Whether or not any additional break-in periods are required, the initial break-in period is so substantial that it would be very helpful to the musician to reduce that time to virtually zero, or at most to just that time required to tune the string when it is initially installed.

The other problem with strings is that the useful life of the string after break-in is limited due to continuous corrosion and pólishing as the string is played. The present invention reduces the break-in period to virtually zero and substantially increases the useful life of a string by filling the pores, cavities, and crevices of the string, and the interstices of windings on a core, with a dry lubricant, such as micronized tetrafluoroethylene (TFE) or preferably polytetrafluoroethylene (PTFE) in a liquid carrier. This is best accomplished by an extended (days) soak in a commercially available TFE or PTFE based moisture displacing lubricant and corrosion inhibitor. Moisture is displaced by, for example, a combination of 1,1,1 trichloroethane and N-amyl acetate. The corrosion inhibitor, which is generally a parafinic oil, may contain such a moisture displacing agent, or simply a low viscosity oil used for lubricating fine machines. There may also be an additive which aids wetting surfaces and allows the TFE and PTFE particles to penetrate. Such an additive may be zinc salts of bialkylphos phorodithioic acid, which also aids in lubricating. This liquid mixture will hold the micronized lubricating particles in suspension, and carry them wherever the liquid will flow by capillary force, not only into the interstices, but also the pores, cavities and crevices. The carrier of the TFE or PTFE also acts as a liquid gasket to hold in the dry lubricants in the interstices of the string. This liquid gasket is held in place by capillary forces.

To shorten the soak period, and more fully lubricate the strings, it is preferred to place the strings in a beaker, and place a vacuum jar over the beaker. By drawing down the air pressure in the jar, air is more easily displaced from the interstices, pores, cavities and crevices by the liquid. PTFE particles in suspension are introduced into the beaker either before or after drawing down the pressure. The capillary forces will then be more effective in carrying the liquid with suspended lubricating particles into the interstices, pores, cavities and crevices. Virtually no air is trapped, and maximum lubrication occurs to reduce the beaker time to just a few seconds, once the vacuum is provided, and to significantly increase the lifetime of the strings.

This vacuum process could be readily adapted to a large scale commercial operation in order to treat large batches of strings several times a day. An alternative to the vacuum soak technique is an ultrasonic bath using an ultrasonic transducer to introduce high frequency pressure waves. This will not only help clear the strings by dislodging any air bubbles but also cause the liquid with suspended PTFE particles to quickly penetrate all interstices, pores, cavities and crevices. The total time required for a batch should be 10 to 15 minutes, less than the total time using the vacuum jar since it does take time to create the vacuum. But either technique will lend itself to large scale, commercial practice of the invention.

For a consumer wishing to practice the invention in the home, either to retreat strings previously treated, or to treat new strings, it is recommended to first immerse the strings in a solvent, such as naptha, and to stir for maximum cleaning of the strings. Then after using a lint free cloth to wipe the excess, the strings are immersed into the lubricant for an extended soak. Stiring the lubricant from time to time over the extended soak period will aid the displacing of all solvent with the lubricant. The displaced solvent will be evaporated quickly during the extended soak period. Any solvent that may remain will evaporate after the strings are removed from the soak. Again a lint free cloth is used to wipe the excess lubricant from the strings.

Figure 3:
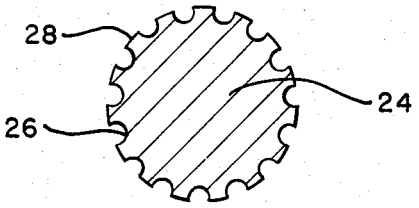
FIG. 3 is a cross section of a metal core provided with longitudinal grooves for a wound string.

In the case of a wound string with a metal core, the metal core 24 shown in FIG. 3 in cross section is preferably extruded with longitudinal grooves 26 to allow for more lubricating particles to be stored between the core and the winding. During the lifetime of the string, as the winding and the lands 28 between the grooves 26 wear, the lubricant in the grooves will continually feed into the pores, cavities, crevices and interstices of the string.

What is claimed is:

1. A method of treating metal musical instrument strings including wound strings to reduce break-in period and extend useful lifetime comprising the steps of cleaning said strings to remove abrasive particles, and fill microscopic pores, cavities and crevices of the strings and the interstices of wound strings with dry lubricant particles.

2. A method as defined in claim 1 including the step of saturating the lubricated string with a liquid moisture displacing agent and corrosion inhibitor.

3. A method as defined in claim 2 wherein the steps of filling with dry lubricant and saturating with a liquid moisture displacing agent and corrosion inhibitor are combined into a single step by placing said lubricating particles in suspension in said liquid, thus using said liquid as a carrier for said dry lubricant.

4. A method as defined in claim 3 including the step of subjecting said strings to a surrounding atmosphere below ambient pressure to facilitate the escape of air from pores, cavities, crevices and interstices, and immersing said strings in said liquid with said particles in suspension while the atmosphere to which said strings are subjected is maintained to low ambient pressure.

5. A method as defined in claim 3 wherein said liquid with lubricating particles is applied by soaking said strings in a bath of said liquid with said particles in suspension for an extended period sufficient for the free atmosphere pressure will cause said liquid and particles to penetrate said pores, cavities, crevices and interstices.

6. A method as defined in claim 1, 2, 3, 4 or 5 including the step of providing longitudinal grooves on the surface of a metal core of said string when wound to allow for more lubricating particles to be stored between said core and windings thereon.

* * * * *